US009010262B2

(12) United States Patent
Aoki

(10) Patent No.: US 9,010,262 B2
(45) Date of Patent: Apr. 21, 2015

(54) TANK SUPPORT STRUCTURE AND FLOATING CONSTRUCTION

(75) Inventor: Eiji Aoki, Tokyo (JP)

(73) Assignee: Japan Marine United Corporation (JP)

( * ) Notice: Subject to any disclaimer, the term of this patent is extended or adjusted under 35 U.S.C. 154(b) by 0 days.

(21) Appl. No.: 14/238,406

(22) PCT Filed: Jul. 20, 2012

(86) PCT No.: PCT/JP2012/068452

§ 371 (c)(1),
(2), (4) Date: Feb. 11, 2014

(87) PCT Pub. No.: WO2012/024661

PCT Pub. Date: Feb. 21, 2013

(65) Prior Publication Data

US 2014/0190393 A1 Jul. 10, 2014

(30) Foreign Application Priority Data

Aug. 12, 2011 (JP) ..... 2011-176833

(51) Int. Cl.

| | |
|---|---|
| ***B63B 25/08*** | (2006.01) |
| ***B63B 25/12*** | (2006.01) |
| ***F17C 1/00*** | (2006.01) |
| ***B63B 35/00*** | (2006.01) |

(52) U.S. Cl.

CPC . *B63B 25/12* (2013.01); *F17C 1/00* (2013.01); *F17C 2201/052* (2013.01); *F17C 2203/015* (2013.01); *F17C 2203/0631* (2013.01); *F17C 2270/0105* (2013.01); *B63B 35/00* (2013.01)

(58) Field of Classification Search

USPC ..... 114/74 A

IPC ..... B63B 25/08; F17C 2203/015

See application file for complete search history.

(56) References Cited

U.S. PATENT DOCUMENTS 1,013,032 A * 12/1911 Lund ..... 108/92
3,122,126 A * 2/1964 Yamada ..... 119/225

(Continued)

FOREIGN PATENT DOCUMENTS

JP 51-82414 7/1976
JP 2000-177681 6/2000

(Continued)

OTHER PUBLICATIONS

International Search Report, PCT/JP2012/068452, Oct. 30, 2012, 2 pp.

*Primary Examiner* — Stephen Avila
(74) *Attorney, Agent, or Firm* — Volpe and Koeing, P.C.

(57) ABSTRACT

A tank support structure includes an inclined surface (21) formed on a side surface section of a housing section (2), a plurality of support base sections (22) arranged on the inclined surface (21), and a plurality of support blocks (4) arranged in a bottom surface section (31) of a tank (3) including a portion opposed to the inclined surface (21) and arranged on the support base sections (22). Support block bottom surfaces (41) arranged on the support base sections (22) of the support blocks (4) and support surfaces (22*a*) of the support base sections (22) that support the support blocks (4) have surfaces parallel to a plane (S) including a segment (CC') connecting two contact points (a first contact point (C) and a second contact point (C')) with the tank (3) in each of the support blocks (4) and a straight line (Lf) passing a fixed point (F) of the tank (3) and parallel to the segment (CC').

18 Claims, 18 Drawing Sheets

(56) References Cited

U.S. PATENT DOCUMENTS

| | | | | | |
|---|---|---|---|---|---|
| 3,839,981 | A * | 10/1974 | Gilles | 114/74 A |
| 4,286,535 | A * | 9/1981 | Lunn | 114/74 R |
| 4,853,123 | A * | 8/1989 | Hayes et al. | 210/316 |
| 5,070,801 | A * | 12/1991 | Frederick | 114/74 R |
| 5,197,409 | A * | 3/1993 | Hammond | 119/253 |

FOREIGN PATENT DOCUMENTS

| | | |
|---|---|---|
| JP | 2003-252287 | 9/2003 |
| JP | 2010-519480 | 6/2010 |

* cited by examiner

TANK SUPPORT STRUCTURE AND FLOATING CONSTRUCTION

TECHNICAL FIELD

The present invention relates to a tank support structure and a floating construction and, more particularly, to a tank support structure and a floating construction for supporting a tank that thermally contracts and thermally expands in a tank housing section including an inclined surface or a multistage surface.

BACKGROUND ART

As a floating construction such as a carrier vessel or an ocean floating facility for carrying or storing liquid cargos such as petroleum, LPG (liquefied petroleum gas), and LNG (liquefied natural gas), a floating construction of an independent tank system is widely used in which tanks for storing the liquid cargos are set independently from the floating construction (see, for example, Patent Literature 1 and Patent Literature 2). When liquefied gas (e.g., LNG) is used as a propellant for ships such as a container ship, an oil tanker, a general cargo ship, and a passenger ship, it is planned to adopt the independent tank system in which a liquefied gas fuel tank is set independently from the hull as in the case of the liquid cargo.

In the floating construction during a voyage or during an anchorage, motions are caused by the influence of the waves; heaving in which the floating construction linearly shakes up and down, swaying in which the floating construction linearly shakes to the left and the right, surging in which the floating construction linearly shakes to the front and the back, pitching in which the head and the tail of the floating construction linearly vibrate up and down around the center, yawing in which the head and the tail of the floating construction vibrate to the left and the right around the center, and rolling in which the sides of the floating construction vibrate up and down with the center as an axis. Actually, complicated motions in which these motions are entangled occur. Therefore, in a tank of the independent tank system relatively movable to the floating construction, it is important to stably support the tank.

For example, in FIG. 5 and FIG. 6 of Patent Literature 1, a structure is disclosed that supports a tank with a bearing sheet, a floating chock (an anti-floatation chock), and a rolling chock (an anti-rolling chock). The bearing sheet is a support structure that supports a vertical load of the tank. The rolling chock (the anti-rolling chock) is a support structure that supports a horizontal load in the case in which the tank shakes in the lateral direction because of rolling of a hull. The floating chock (the anti-floatation chock) is a support structure that suppresses a lift of the tank during submersion. Therefore, the deadweight of the floating construction and loads of the motions of the floating construction caused by the influence of the waves are mainly supported by the bearing sheet and the rolling chock (the anti-rolling chock). As described in Patent Literature 1, the bearing sheet is arranged in the bottom section of the hull and the rolling chock (the anti-rolling chock) is arranged in the ceiling section and the bottom section of the hull.

In FIG. 14 and FIG. 15 of Patent Literature 2, a support structure is disclosed including a base support that supports a base of a tank for supporting the weight of the tank, a tank support surface provided on the tank, and a hold support surface provided on a hold and configured to cooperate with the tank support surface. The support surfaces extend toward a direction of heat transfer of the tank and extend at an intermediate angle between the horizontal direction and the vertical direction to suppress the movement in the lateral direction of the tank with respect to the hold. Note that the tank support surface and the hold support surface cooperating with each other extend toward a direction to the center of the base of the tank along the direction of the heat transfer.

CITATION LIST

Patent Literature

Patent Literature 1: Japanese Patent Laid-Open No. 2000-177681

Patent Literature 2: National Publication of International Patent Application No. 2010-519480

SUMMARY OF INVENTION

Technical Problem

However, in the tank support structure, the vertical load of the tank is supported by a support member arranged in the bottom section of a housing section. Therefore, when a tank housing section is arranged in a narrow portion such as a bow section or when an area sufficient for supporting the tank bottom section cannot be secured because of an arrangement relation with other devices, the tank support structure cannot be adopted. If it is attempted to adopt the tank support structure as it is, the tank has to be designed according to the housing section having a small area. There are problems in that, for example, volume efficiency is deteriorated and the support structure is complicated.

In particular, when low-temperature liquefied gas such as LPG or LNG is encapsulated in the tank, since the tank thermally contracts and thermally expands, the tank support structure has to be a structure that can cope with the thermal contraction and the thermal expansion of the tank.

The present invention has been devised in view of the problems and it is an object of the present invention to provide a tank support structure and a floating construction that can cope with thermal contraction and thermal expansion of a tank and improve volume efficiency even when a tank housing section has an inclined surface or a multistage surface.

Solution to Problem

According to the present invention, there is provided a tank support structure for a tank mounted on a housing section formed in a floating construction, the tank support structure including: an inclined surface or a multistage surface formed on a side surface section of the housing section; a plurality of support base sections arranged on the inclined surface or the multistage surface; and a plurality of support blocks arranged in a bottom surface section of the tank including a portion opposed to the inclined surface or the multistage surface and arranged on the support base sections, wherein support block bottom surfaces arranged on the support base sections of the support blocks and support surfaces of the support base sections that support the support blocks have surfaces parallel to a plane including a segment connecting two contact points with the tank in each of the support blocks and a straight line passing a fixed point of the tank and parallel to the segment.

According to the present invention, there is provided a floating construction including: a main body section supported on the water by buoyancy; and the housing section formed in the main body section and having a tank mounted therein, wherein the tank includes: an inclined surface or a multistage surface formed on a side surface section of the housing section; a plurality of support base sections arranged on the inclined surface or the multistage surface; and a plurality of support blocks arranged in a bottom surface section of the tank including a portion opposed to the inclined surface or the multistage surface and arranged on the support base sections, and support block bottom surfaces arranged on the support base sections of the support blocks and support surfaces of the support base sections that support the support blocks are mounted on the housing section by a tank support structure having surfaces parallel to a plane including a segment connecting two contact points with the tank in each of the support blocks and a straight line passing a fixed point of the tank and parallel to the segment.

In the tank support structure and the floating construction, the tank support structure and the floating construction may include: a locking base section arranged in a bottom surface center section of the housing section; and a locking block arranged in a bottom surface center section of the tank and arranged on the locking base section. The fixed point may be formed by locking the locking block to the locking base section. Further, at least one of the locking base section may be arranged along a center line direction of the floating construction and at least one of the locking base section may be arranged along a width direction perpendicular to the center line direction, whereby the fixed point may be formed at an intersection of the center line direction and the width direction.

At least one of the two contact points may be a contact point of the support block with the tank most distant from the fixed point. The support surfaces may be formed wider than the support block bottom surfaces in an inclining direction.

In the bottom surface section of the tank, the area of the portion opposed to the inclined surface or the multistage surface may be formed larger than a portion opposed to the bottom surface section of the housing section. The tank may include a frame body section that locks the support blocks. The tank may include leg sections projecting downward. The support blocks are arranged on the leg sections. The support block bottom surfaces and the support surfaces may be formed with the leg sections set as a part of the tank. The tank may include a sidewall section having fixed width along the center line direction of the floating construction or a sidewall section, the width of which changes along the center line direction of the floating construction.

Advantageous Effects of Invention

With the tank support structure and the floating construction according to the present invention, the side surface section of the housing section is formed to include the inclined surface or the multistage surface and the support block bottom surfaces and the support surfaces are formed to include the surfaces parallel to the plane including the segment connecting the two contact points with the support blocks and the tank and the straight line passing the fixed point of the tank and parallel to the segment. Therefore, even when the tank housing section includes the inclined surface or the multistage surface, it is possible to arrange the bottom surface section of the tank along the inclined surface or the multistage surface and it is possible to improve volume efficiency. Further, the support block bottom surfaces and the support surfaces are formed in a direction in which the support block surfaces and the support surfaces move along thermal contraction and thermal expansion of the tank. Therefore, it is possible to support the tank following the thermal contraction and the thermal expansion of the tank.

DESCRIPTION OF EMBODIMENTS

Figure 1A:
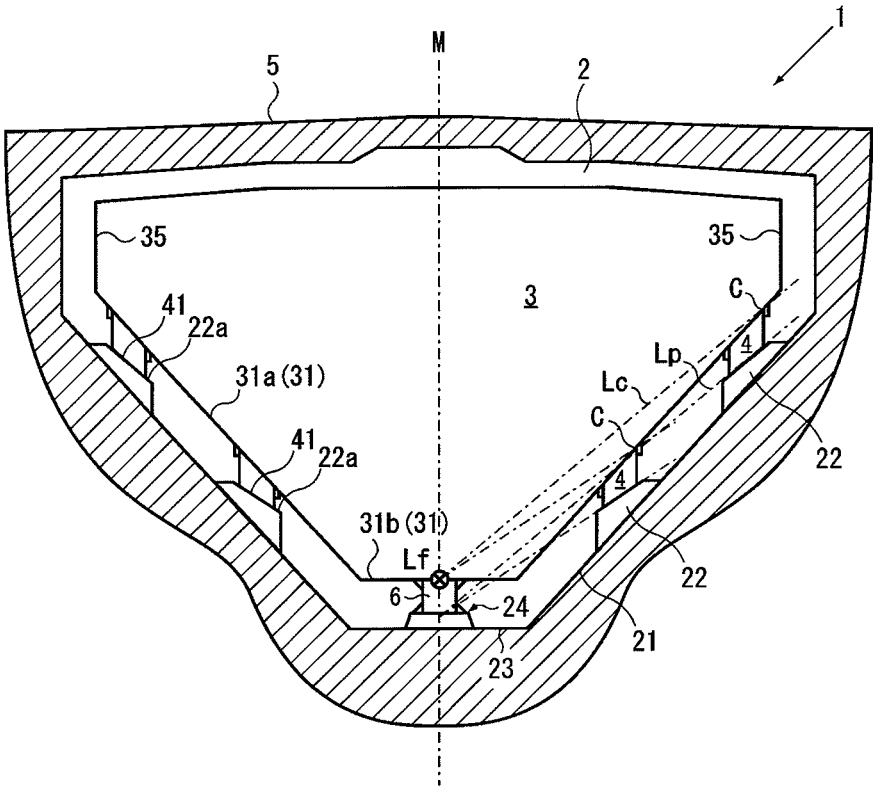
FIG. 1A is a sectional view showing a tank support structure according to a first embodiment of the present invention.
Figure 1B:
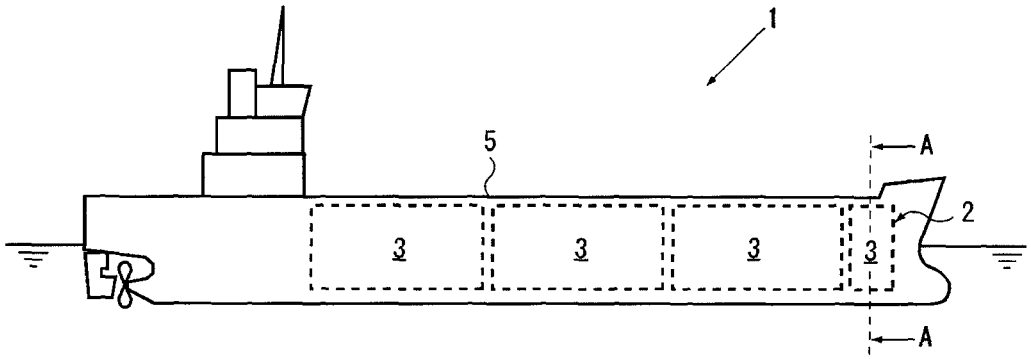
FIG. 1B is an overall configuration diagram of a floating construction including the tank support structure shown in FIG. 1A.
Figure 2A:
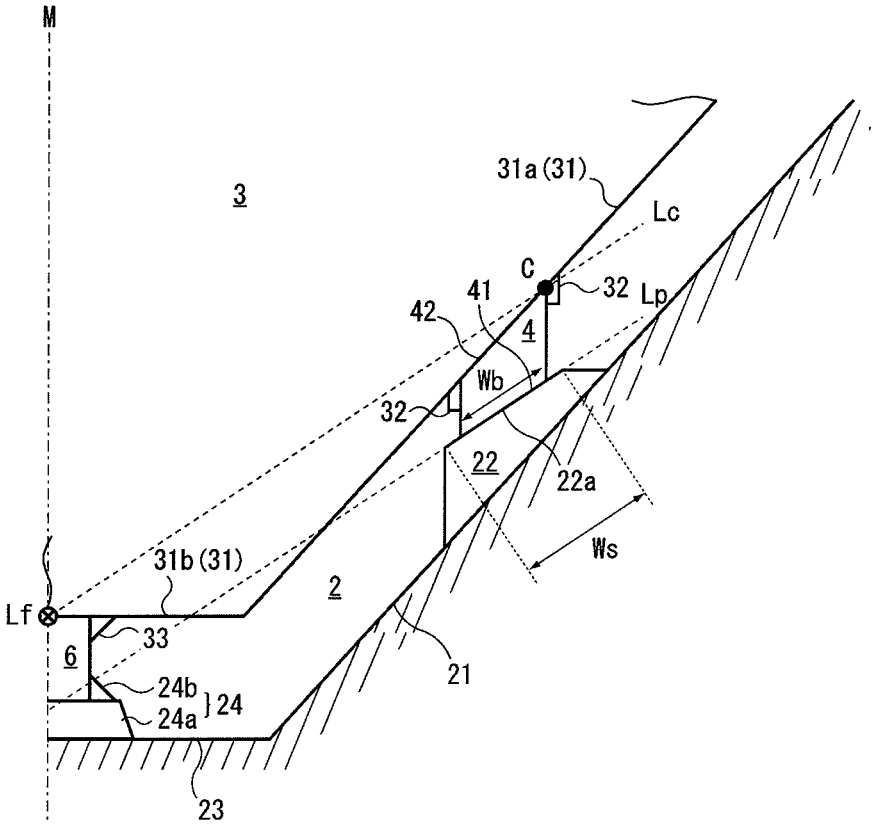
FIG. 2A is an enlarged view of the tank support structure.
Figure 2B:
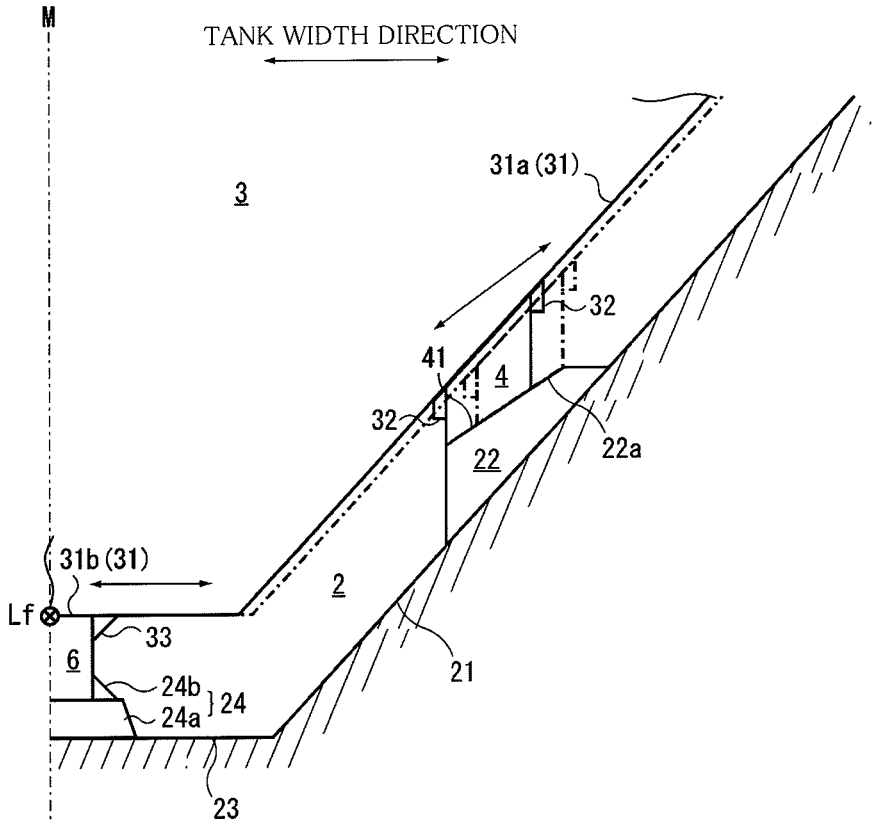
FIG. 2B is an action explanatory diagram of the tank support structure.

Embodiments of the present invention are explained below with reference to FIG. 1 to FIG. 7. FIG. 1 is a diagram showing a tank support structure according to a first embodiment of the present invention. FIG. 1A is a sectional view and FIG. 1B is an overall configuration diagram of a floating construction including the tank support structure shown in FIG. 1A. FIG. 2 is an explanatory diagram of the tank support structure. FIG. 2A is an enlarged view and FIG. 2B is an action explanatory diagram.

As shown in FIG. 1A, the tank support structure according to the first embodiment of the present invention is a tank support structure for a tank 3 mounted on a housing section 2 formed in a floating construction 1. The tank support structure includes an inclined surface 21 formed on a side surface section of the housing section 2, a plurality of support base sections 22 arranged on the inclined surface 21, and a plurality of support blocks 4 arranged in a bottom surface section 31 of the tank 3 including a portion opposed to the inclined surface 21 and arranged on the support base sections 22.

Figure 5A:
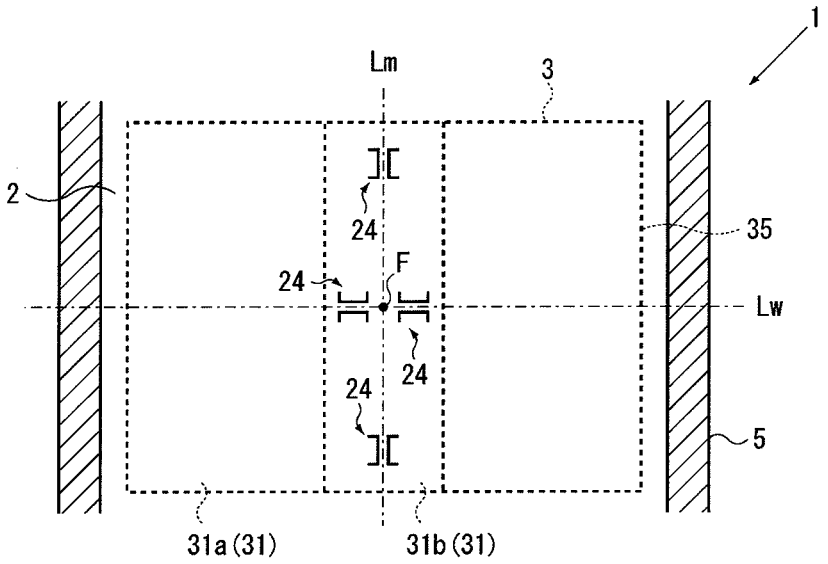
FIG. 5A is a diagram showing a fixed point in a parallel tank and shows the case in which the depth is large.
Figure 5B:
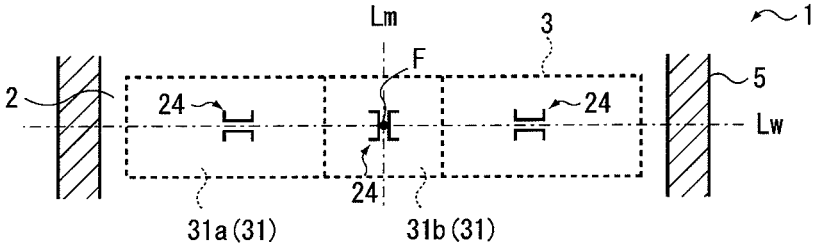
FIG. 5B is a diagram showing the fixed point in the parallel tank and shows the case in which the depth is small.
Figure 5C:
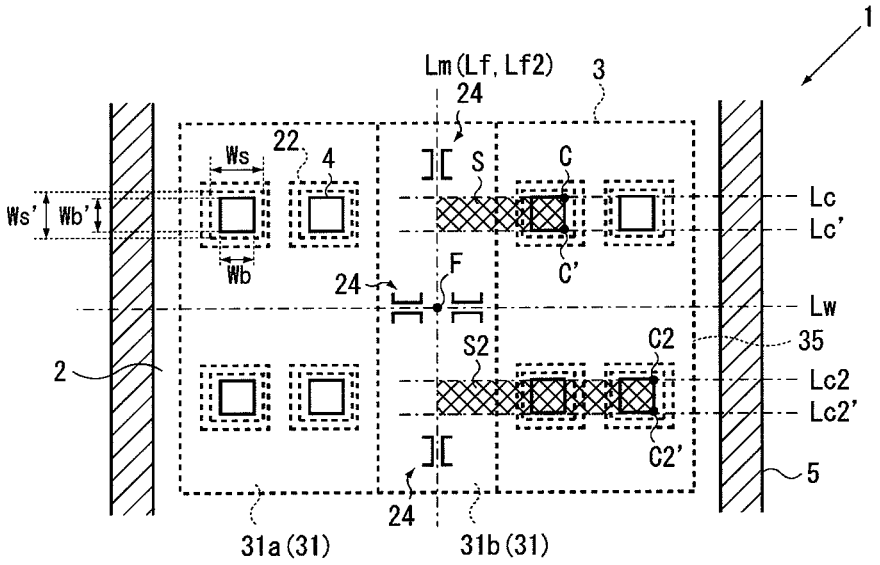
FIG. 5C is a diagram showing the fixed point in the parallel tank and shows a positional relation between two contact points and the fixed point.

Support block bottom surfaces 41 arranged on the support base sections 22 of the support blocks 4 and support surfaces 22*a* of the support base sections 22 that support the support blocks 4 have surfaces parallel to a plane S including a segment CC' connecting two contact points (a first contact point C and a second contact point C') with the tank 3 in each of the support blocks 4 and a straight line Lf passing a fixed point F of the tank 3 and parallel to the segment CC' (see FIG. 5C). That is, the plane S includes a perpendicular Lc drawn down from the first contact point C to the straight line Lf and a perpendicular Lc' drawn down from the second contact point C' to the straight line Lf. Note that a positional relation among the segment CC', the fixed point F, the straight line Lf, the perpendicular Lc', and the plane S is explained below with reference to FIG. 5C. It is assumed that the tank 3 is a so-called parallel tank including a sidewall section 35 having fixed width along a center line direction Lm of the floating construction 1.

As shown in FIG. 1B, the floating construction 1 includes a main body section 5 supported on the water by buoyancy and a housing section 2 formed in the main body section 5 and having tanks 3 mounted therein. The floating construction 1 shown in the figure is, for example, an LNG ship of an independent square type. Note that the floating construction 1 may be an oil transport ship, an LPG ship, a chemical tanker, or the like or may be an LNG ocean floating facility (e.g., FPSO) of the independent square type as long as the floating construction 1 is a ship including the tank 3 of the independent square type. The floating construction 1 may be a ship such as a container ship, an oil tanker, a general cargo ship, or a passenger ship including a liquefied gas fuel tank for storing liquefied gas (e.g., LNG), which is a propellant.

The sectional view of the tank support structure shown in FIG. 1A is, for example, an A-A sectional view in FIG. 1B. A hull (the main body section 5) in a bow section (e.g., an A-A line section) is formed such that the width of a ship bottom section is narrowed. As shown in FIG. 1A, the housing section 2 includes the inclined surface 21 and includes a side surface of a substantially V shape. The housing section 2 includes a bottom surface section 23 configuring a substantially horizontal surface arranged below the tank 3. A locking base section 24 that supports the tank 3 in the horizontal direction is arranged substantially in the center section of the bottom surface section 23 (a bottom surface center section).

The locking base section 24 includes, for example, a support table 24*a* that supports a vertical load of the tank 3 and a pair of protrusion sections 24*b* formed in the support table 24*a* along the center line extending in the longitudinal direction of the floating construction 1. The locking base section 24 restrains a locking block 6 with the protrusion sections 24*b* to thereby regulate movement of the tank 3 in the horizontal direction (the tank width direction) while allowing movement in the center line direction Lm and form the fixed point F on the straight line Lf. The locking base section 24 only has to be configured to be capable of coping with at least thermal expansion and contraction in the width direction of the tank 3. Further, the locking base section 24 may be configured to be capable of supporting a horizontal load due to rolling of the floating construction 1. Note that, although not shown in the figure, in the bottom surface section 23 of the housing section 2, a plurality of support base sections that support the vertical load of the tank 3 may be arranged on both sides of the locking base section 24. As in the conventional tank support structure, an anti-rolling chock may be arranged above an anti-floatation chock or the tank 3.

As shown in FIG. 1A, for example, in the housing section 2 formed in the bow section, the area of the bottom surface section 23 is small. The vertical load of the tank 3 cannot be supported by the locking base section 24 arranged in the bottom surface section 23. This is the same when the support base sections are arranged on both sides of the locking base section 24. The housing section 2 includes the inclined surface 21 having a large area compared with the bottom surface section 23. Therefore, the bottom surface section 31 of the tank 3 is also formed such that the area of a portion (an inclined section 31*a*) opposed to the inclined surface 21 is larger than a portion (a horizontal section 31*b*) opposed to the bottom surface section 23 of the housing section 2. The present invention makes it possible to support the vertical load of the tank 3 using the inclined surface 21 of the housing section 2.

The tank 3 is a tank that stores a liquid cargo such as petroleum, LPG, or LNG. It is assumed that the tank 3 stores LNG. LNG is obtained by cooling natural gas of a gaseous body to temperature equal to or lower than about −160° and changing the natural gas to liquid. LNG needs to be maintained at low temperature. Therefore, a panel-like heat insulator (not shown in the figure) is spread around the outer circumference of the tank 3. Such a tank 3 is an independent tank constructed independently from the hull (the main body section 5) and is placed on the inside of the housing section 2. Note that the tank 3 may be a liquefied gas fuel tank that stores liquefied gas (e.g., LNG), which is a propulsion, in a normal ship such as a container ship, an oil tanker, a general cargo ship, or a passenger ship.

As shown in FIG. 2A, the support base section 22 is formed on the inclined surface 21 of the housing section 2. The support surface 22*a* is formed on the surface of the support base section 22. The inclined section 31*a* in the bottom surface section 31 of the tank 3 includes an inclined surface substantially parallel to the inclined surface 21 of the housing section 2. In the bottom surface section 31 (the inclined section 31*a*) of such a tank 3, a frame body section 32 that locks the support block 4 is arranged. The horizontal section 31*b* in the bottom surface section 31 of the tank 3 includes a horizontal surface substantially parallel to the bottom surface section 23 of the housing section 2. In the bottom surface section 31 (the horizontal section 31*b*) of such a tank 3, a frame body section 33 that locks the locking block 6 is arranged. The frame body sections 32 and 33 are formed in an annular shape that surrounds the outer circumference of the support block 4. The frame body sections 32 and 33 include concave sections opened downward.

The support block 4 and the locking block 6 are configured by, for example, square wood and are fit and locked by being pushed into the frame body sections 32 and 33. The support block 4 includes a support block bottom surface 41 that is in contact with the support surface 22*a* of the support base section 22 and a support block upper surface 42 that is in contact with the bottom surface section 31 (the inclined surface) of the tank 3. Note that, as the support block 4, a support block same as the conventional support block can be used as appropriate. For example, a support block configured by a material having low heat conductivity and elasticity such as rubber or resin or a support block obtained by fixing the material on the surface of a square timber may be used. The support block 4 may be fixed to the frame body section 33 by a metal fixture.

The tank 3 thermally contracts or thermally expands depending on a stored object. However, the fixed point F is a point on a hull center axis M in the bottom surface section 31 (the horizontal section 31*b*) of the tank 3. That is, the fixed point F is a point, the position of which does not deviate even when the tank 3 thermally contracts or thermally expands.

Therefore, all points on the wall surface of the tank 3 thermally contract or thermally expand toward the fixed point F.

As shown in FIG. 2A, if the perpendicular Lc is drawn down from the first contact point C of the support block 4 with the tank 3 onto the straight line Lf passing the fixed point F of the tank 3, when the first contact point C thermally contracts or thermally expands, the first contact point C moves along the perpendicular Lc in the cross section shown in FIG. 2A. The first contact point C is set at, for example, a contact point of the support block 4 with the tank 3 most distant from the fixed point F. As the first contact point C, any point (e.g., an intermediate point or a closest point) of the support block upper surface 42 may be set as long as the point is a contact point of the support block 4 with the tank 3. However, in view of the fact that a moving distance in the case of thermal contraction or thermal expansion of the tank 3 is longer further away from the fixed point F, the first contact point C is desirably set at a point on the support block upper surface 42 most distant from the fixed point F. The second contact point C' is desirably set at an end point on a side including the first contact point C of the support block upper surface 42 (see FIG. 5C).

A plane including the perpendicular Lc and extending in the center line direction Lm (a direction perpendicular to paper surface) of the floating construction 1 is assumed. The plane coincides with the plane S including the segment CC' and the straight line Lf and a sectional view of the plane coincides with the perpendicular Lc when the two contact points (the first contact point C and the second contact point C') are at the same height (horizontal position) and the segment CC' is set in parallel to the sidewall section 35. The support surface 22*a* of the support base section 22 and the support block bottom surface 41 of the support block 4 are formed to be surfaces parallel to the plane including the perpendicular Lc (a sectional view of the surfaces coincides with the straight line Lp). That is, the perpendicular Lc and the straight line Lp have a relation in which the perpendicular Lc and the straight line Lp are parallel to each other.

The support block 4 slides on the support surface 22*a* of the support base section 22. Therefore, the support surface 22*a* is formed wider than the support block bottom surface 41 in the perpendicular Lc direction (i.e., the inclining direction). Specifically, the support block bottom surface 41 of the support block 4 has width Wb in the perpendicular Lc direction. The support surface 22*a* of the support base section 22 has width Ws in the perpendicular Lc direction. The width Wb and the width Ws have a relation Ws>Wb. Further, the support block bottom surface 41 of the support block 4 may have width Wb' in the center line direction Lm. The support surface 22*a* of the support base section 22 may have width Ws' in the center line direction Lm direction. The width Wb' and the width Ws' may have a relation Ws'>Wb' (see FIG. 5C).

With such a tank support structure, at least the vertical load of the tank 3 can be supported by the support base section 22 via the support block 4. Even when the housing section 2 of the tank 3 includes the inclined surface 21, the bottom surface section 31 (the inclined section 31*a*) of the tank 3 can be arranged along the inclined surface 21 and volume efficiency can be improved. Note that, in such an embodiment, when the horizontal load of the tank 3 can be supported by the support block 4 and the support base section 22, a so-called anti-rolling chock may be omitted.

When the tank 3 thermally contracts or thermally expands, the tank 3 moves as shown in FIG. 2B. The thermal contraction is indicated by a solid line and the thermal expansion is indicated by an alternate long and short dash line. The bottom surface section 31 of the tank 3 thermally contracts or thermally expands toward the fixed point F. As a result, the bottom surface section 31 has a shape expanded or contracted in the width direction of the tank 3. At this point, since the support block upper surface 42 is restrained by the frame body section 33, as shown in the figure, the support block 4 moves between the solid lines or the alternate long and short dash lines and the support block bottom surface 41 slides on the support surface 22*a* of the support base section 22. In this way, the support block bottom surface 41 and the support surface 22*a* are formed in the direction in the support block bottom surface 41 and the support surface 22*a* move along the thermal contraction or the thermal expansion of the tank 3. Therefore, it is possible to support the tank 3 while following the thermal contraction or the thermal expansion of the tank 3.

Figure 3A:
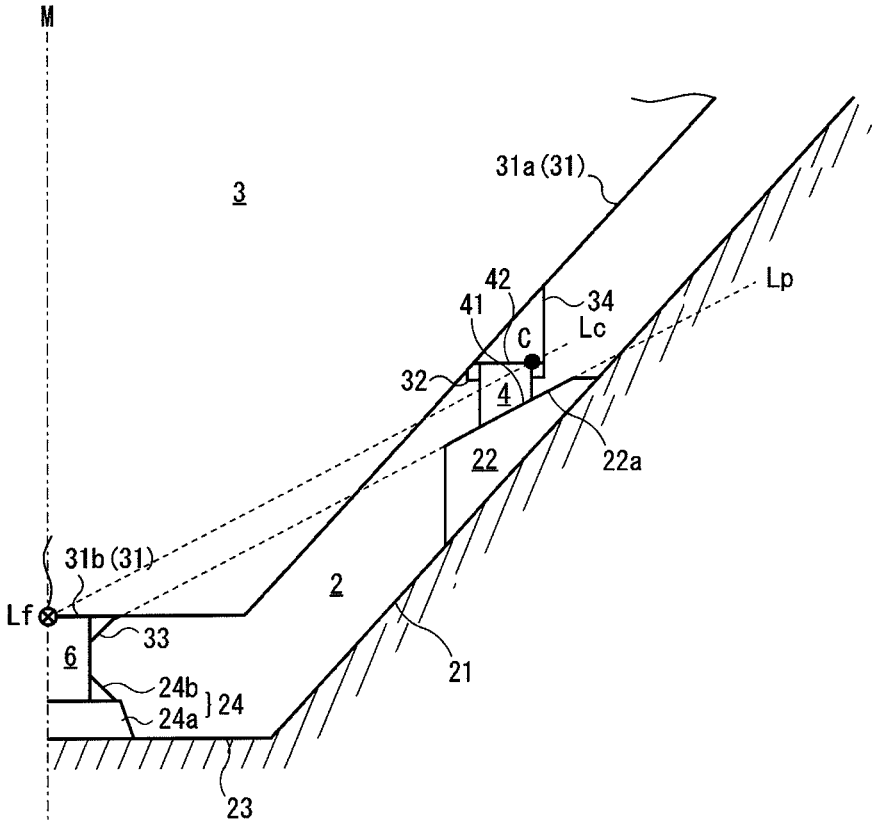
FIG. 3A is a diagram showing a tank support structure according to a second embodiment of the present invention.
Figure 3B:
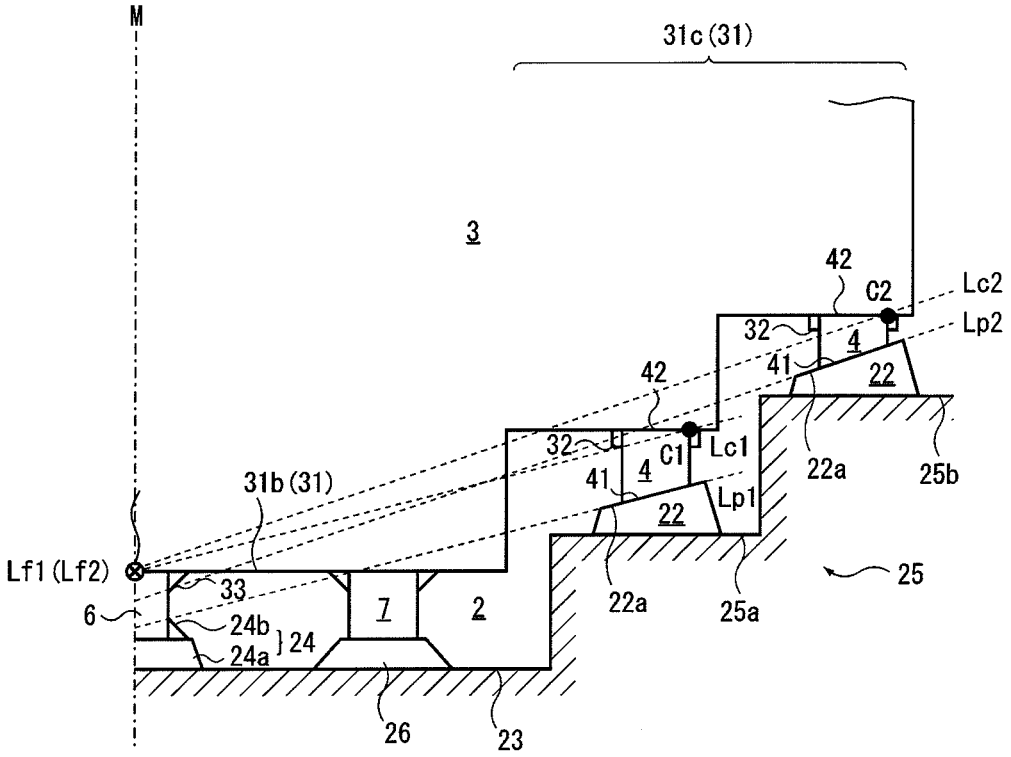
FIG. 3B is a diagram showing a tank support structure according to a third embodiment of the present invention.
Figure 4A:
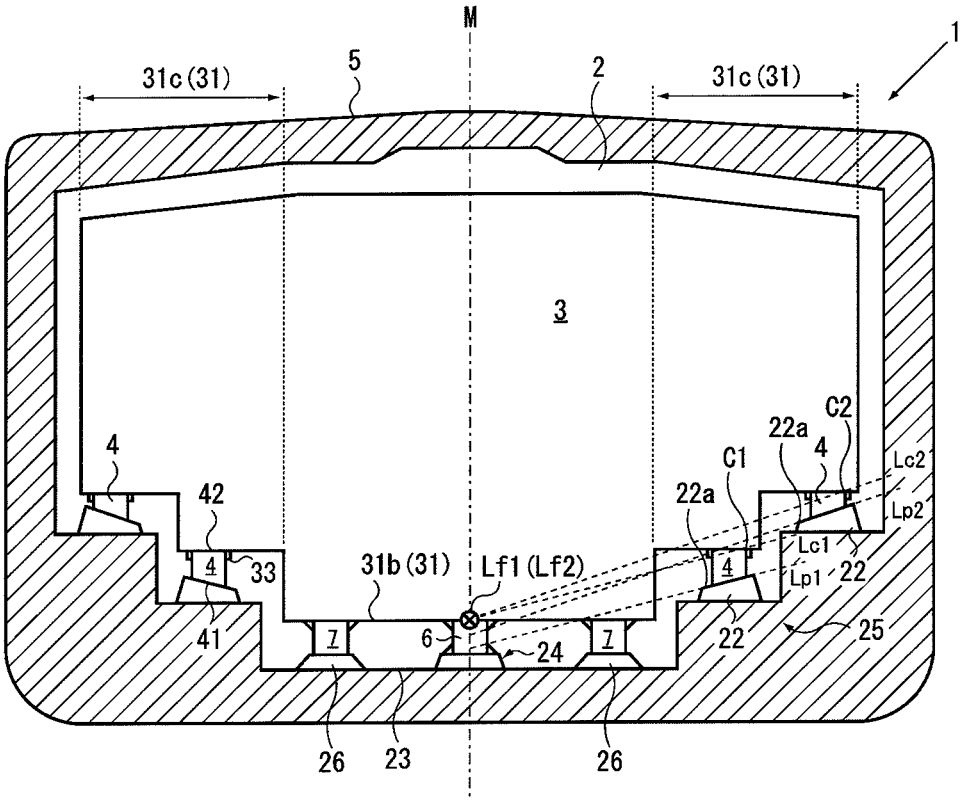
FIG. 4A is a diagram showing a tank support structure according to a fourth embodiment of the present invention.
Figure 4B:
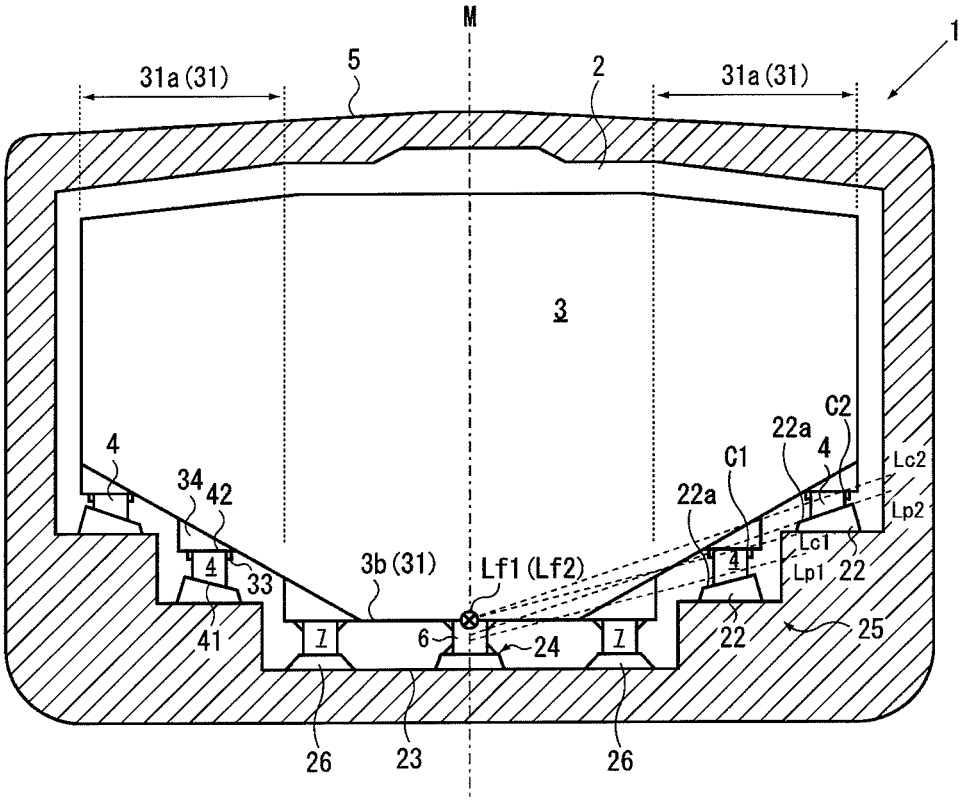
FIG. 4B is a diagram showing a tank support structure according to a fifth embodiment of the present invention.

Next, tank support structures according to other embodiments of the present invention are explained with reference to FIG. 3 and FIG. 4. FIG. 3 is a diagram showing the tank support structures according to the other embodiments of the present invention. FIG. 3A shows a second embodiment. FIG. 3B shows a third embodiment. FIG. 4 is a diagram showing the tank support structures according to the other embodiments of the present invention. FIG. 4A shows a fourth embodiment. FIG. 4B shows a fifth embodiment. The tank 3 shown in the figures is a parallel tank as in the first embodiment. Note that components same as those of the tank support structure in the first embodiment are denoted by the same reference numerals and signs and redundant explanation of the components is omitted.

In the tank support structure according to the second embodiment shown in FIG. 3A, the tank 3 includes a leg section 34 projecting downward, the support block 4 is arranged in the leg section 34, and the support block bottom surface 41 and the support surface 22*a* are formed with the leg section 34 set as a part of the tank 3. Depending on the shape of the tank 3, the leg section 34 projecting downward in the vertical direction from the inclined section 31*a* of the bottom surface section 31 is welded and arranged and the lower surface of the leg section 34 is formed as a substantially horizontal surface, whereby the support block upper surface 42 can be formed as a substantially horizontal surface and the support block 4 can be easily molded. The frame body section 33 that locks the support block 4 is arranged on the lower surface or the side surface of the leg section 34. Note that the leg section 34 is configured by, for example, a material of the same quality as the material forming the tank 3.

In such a second embodiment, the leg section 34 is regarded as a part of the tank 3. The shapes of the support block bottom surface 41 and the support surface 22*a* are set by a method same as the method in the first embodiment. That is, the support block bottom surface 41 and the support surface 22*a* of the support base section 22 are surfaces parallel to the plane S including the segment CC' connecting the two contact points (the first contact point C and the second contact point C') with the tank 3 in each of the support blocks 4 and the straight line Lf passing the fixed point F of the tank 3 and parallel to the segment CC'. In other words, when the two contact points (the first contact point C and the second contact point C') are at the same height (horizontal position) and the segment CC' is set in parallel to the sidewall section 35, the support block bottom surface 41 and the support surface 22*a* of the support base section 22 are formed to include surfaces parallel to a plane including the perpendicular Lc and extending in the center line direction Lm (a sectional view of the surfaces coincides with the straight line Lp).

Further, in other words, the support block bottom surface 41 and the support surface 22*a* of the support base section 22 include surfaces parallel to a plane (the plane coincides with the plane S) including a straight line connecting the first contact point C and the fixed point F and a straight line connecting the second connection point C' and the fixed point F.

The tank support structure according to the third embodiment shown in FIG. 3B includes a multistage surface 25 formed in the side surface section of the housing section 2 and the plurality of support base sections 22 arranged on the multistage surface 25. When the housing section 2 includes the multistage surface 25, as shown in the figure, the bottom surface section 31 of the tank 3 includes a portion (a multistage section 31*c*) opposed to the multistage surface 25. For example, when the multistage surface 25 is set as a first step section 25*a*, a second step section 25*b*, . . . from a lower stage to an upper stage, the support base sections 22 may be arranged only in the step sections in places necessary in terms of design.

In such a third embodiment, the multistage surface 25 of the housing section 2 and the multistage section 31*c* of the tank 3 opposed to each other have surfaces in the substantially horizontal direction. As in the first embodiment, the support block bottom surface 41 and the support surface 22*a* are formed to include surfaces parallel to a plane S1, S2 including a segment C1C1', C2C2' connecting the two contact points (the first contact pint C1, C2 and the second contact point C1', C2') of the tank 3 in each of the support blocks 4 and a straight line Lf1, Lf2 passing the fixed point F of the tank 3 and parallel to the segment C1C1', C2C2'. In other words, when the two contact points (the first contact point C1, C2 and the second contact point C1', C2') are the same height (horizontal position) and the segment C1C1', C2C2' is set parallel to the sidewall section 35, the support block bottom surface 41 and the support surface 22*a* are formed to include surfaces parallel to a plane including straight line Lc1, Lc2 and extending in the center line direction Lm (a sectional view of the surfaces coincides with straight line Lp1, Lp2). Note that, when the two contact points (the first contact point C1, C2 and the second contact point C1', C2') in each of the support blocks 4 are at the same height (horizontal position) and the segment C1C1', C2C2' is set in parallel to the sidewall section 35, the straight line Lf1 and the straight line Lf2 coincide with each other.

Further, in other words, the support block bottom surface 41 and the support surface 22*a* of the support base section 22 in a certain position include surfaces parallel to a plane (the plane coincides with the plane S1) including a straight line connecting the first contact point C1 and the fixed point F and a straight line connecting the second contact point C1' and the fixed point F. The support block bottom surface 41 and the support surface 22*a* of the support base section 22 in another position include surfaces parallel to a plane (the plane coincides with the plane S2) including a straight line connecting the first contact point C2 and the fixed point F and a straight line connecting the second contact point C2' and the fixed point F. Note that, in such a third embodiment, in FIG. 5C, the first contact point C reads as C1, the perpendicular Lc reads as Lc1, the second contact point C' reads as C1', the perpendicular Lc' reads as Lc1', and the plane S reads as S1.

Note that, as shown in FIG. 3B, when the area of the bottom surface section 23 of the housing section 2 is relatively large, a support base section 26 that supports the vertical load of the tank 3 may be arranged in the bottom surface section 23 and a support block 7 locked to the bottom surface section 31 (the horizontal section 31*b*) of the tank 3 may be arranged.

In the tank support structure according to the fourth embodiment shown in FIG. 4A, it is assumed that the housing section 2 includes the multistage surface 25 in the hull (the main body section 5) in which the ship bottom section of the floating construction 1 is formed wide. That is, as in the third embodiment, the tank support structure according to the fourth embodiment includes the multistage surface 25 formed on the side surface section of the housing section 2 and the plurality of support base sections 22 arranged on the multistage surface 25. The support block bottom surface 41 and the support surface 22*a* are formed to include surfaces parallel to the plane S1, S2 including the segment C1C1', C2C2' connecting the two contact points (the first contact point C1, C2 and the second contact point C1', C2') with the tank 3 in each of the support blocks 4 and the straight line Lf1, Lf2 passing the fixed point F of the tank 3 and parallel to the segment C1C1', C2C2'. In other words, when the two contact points (the first contact point C1, C2 and the second contact point C1', C2') are at the same height (horizontal position) and the segment C1C1', C2C2' is set in parallel to the sidewall section 35, the support block bottom surface 41 and the support surface 22*a* are formed to include surfaces parallel to a plane including the straight line Lc1, Lc2 and extending in parallel to the center line direction Lm (a sectional view of the surfaces coincides with the straight line Lp1, Lp2). Note that, when the two contact points (the first contact point C1, C2 and the second contact point C1', C2') in each of the support blocks 4 are at the same height (horizontal position) and the segment C1C1', C2C2' is set in parallel to the sidewall section 35, the straight line Lf1 and the straight line Lf2 coincide with each other.

Further, in other words, the support block bottom surface 41 and the support surface 22*a* of the support base section 22 in a certain position include surfaces parallel to a plane (the plane coincides with the plane S1) including the straight line connecting the first contact point C1 and the fixed point F and the straight line connecting the second contact point C1' and the fixed point F. The support block bottom surface 41 and the support surface 22*a* of the support base section 22 in another position include surfaces parallel to a plane (the plane coincides with the plane S2) including the straight line connecting the first contact point C2 and the fixed point F and the straight line connecting the second contact point C2' and the fixed point F. Note that, in such a fourth embodiment, in FIG. 5C, the first contact point C reads as C1, the perpendicular Lc reads as Lc1, the second contact point C' reads as C1', the perpendicular Lc' reads as Lc1', and the plane S reads as S1.

The floating construction 1 sometimes includes, in a portion other than the bow section and the stern section, the multistage surface 25 shown in the figure because of a relation in arrangement of pipes and other onboard devices and a relation with the shape of a cargo to be loaded. In particular, originally, the multistage surface 25 is easier to form when the tank 3 that stores a liquid cargo such as LNG or a propellant is mounted later on the floating construction 1, in which the shape of the housing section 2 is limited. When the multistage surface 25 is formed in this way, conventionally, the area of the bottom surface section 23 of the housing section 2 sometimes does not have a size sufficient for supporting the tank 3. Then, the shape of the tank 3 has to be reduced according to the area of the bottom surface section 23 of the housing section 2. This causes deterioration in volume efficiency. Further, it is necessary to design the floating construction 1 such that the multistage surface 25 is not formed in the housing section 2. Consequently, constrains in design increase, there is difficulty in arrangement of pipes and other onboard devices and there is difficulty in securing a sufficient volume in setting the tank 3 anew in the existing floating construction 1.

However, by adopting the tank support structure in the fourth embodiment, even when the housing section 2 includes the multistage surface 25, the external shape of the tank 3 is designed according to the shape of the housing section 2 and the bottom surface section 31 (the multistage section 31*c*) of the tank 3 is supported by the multistage surface 25. Consequently, it is possible to improve volume efficiency and it is possible to relax the constraints in design.

In the tank support structure according to the fifth embodiment shown in FIG. 4B, as in the fourth embodiment, when the housing section 2 includes the multistage surface 25, it is assumed that the bottom surface section 31 of the tank 3 is not formed in multiple stages but is inclined (the inclined section 31*a* is formed). In this way, when the shape of the bottom surface section 31 of the tank 3 is different from the shape of the multistage surface 25, which is the side surface section of the housing section 2, for example, the leg sections 34 projected downward to the bottom surface section 31 (the inclined section 31*a*) of the tank 3 only have to be arranged. By arranging such leg sections 34, it is possible to substantially configure a tank support structure equivalent to the tank support structure in the fourth embodiment. Note that, even when the bottom surface section 31 of the tank 3 includes an inclined surface and the housing section 2 includes the multistage surface 25, the support blocks 4 may be arranged without arranging the leg sections 34.

With the tank support structures according to the first embodiment to the fifth embodiment, even when the housing section 2 includes the inclined surface 21 or the multistage surface 25 and the area of the bottom surface section 23 sufficient for supporting the vertical load of the tank 3 cannot be secured, it is possible to support the vertical load of the tank 3 using the inclined surface 21 or the multistage surface 25. It is possible to form the shape of the tank 3 along the inclined surface 21 or the multistage surface 25 and it is possible to improve volume efficiency. By combining such embodiments as appropriate, even in the housing section 2 having a complicated shape, it is possible to form and arrange the tank 3 having high volume efficiency adapted to the shape of the housing section 2.

Figure 6A:
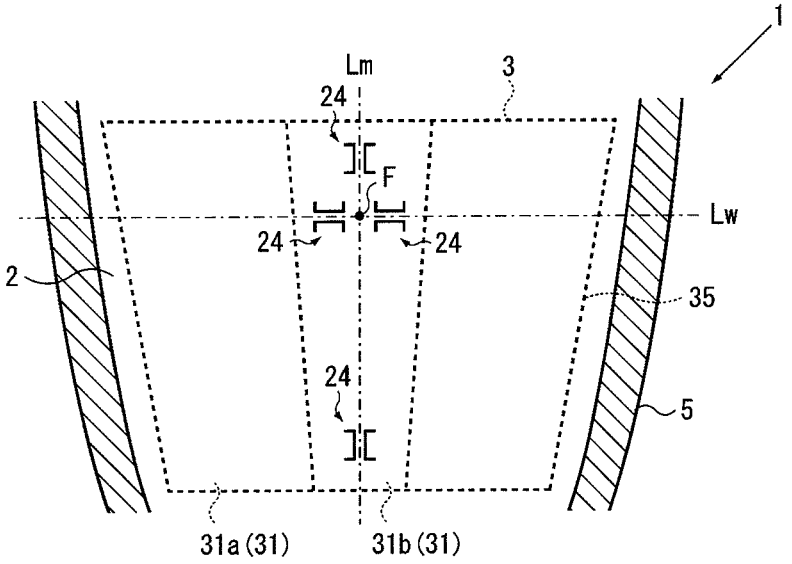
FIG. 6A is a diagram showing a fixed point in a taper tank and shows the case in which the depth is large.
Figure 6B:
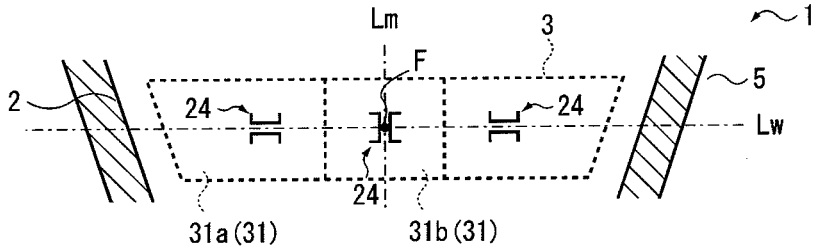
FIG. 6B is a diagram showing the fixed point in the taper tank and shows the case in which the depth is small.
Figure 6C:
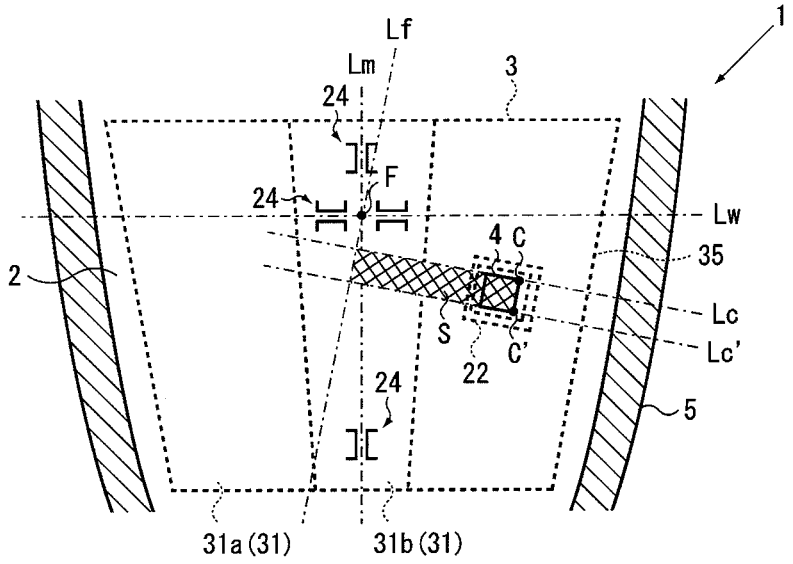
FIG. 6C is a diagram showing the fixed point in the taper tank and shows a positional relation between two contact points and the fixed point.
Figure 6D:
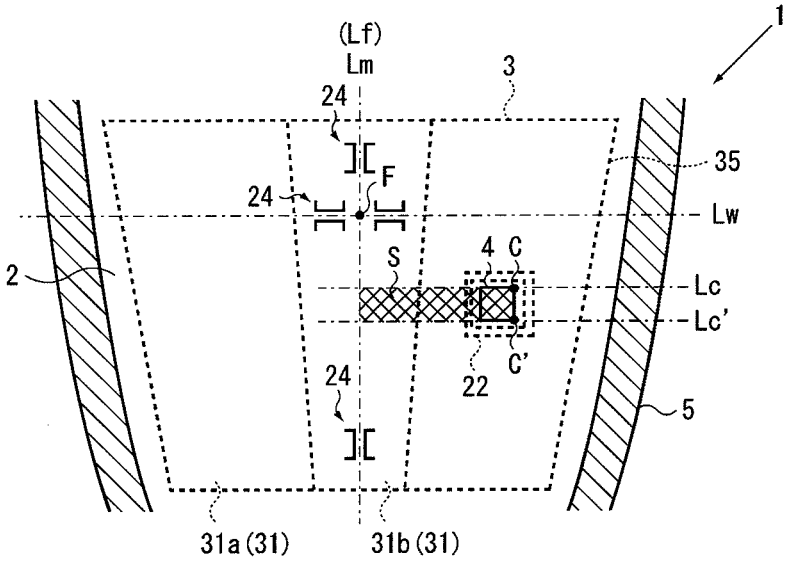
FIG. 6D is a diagram showing the fixed point in the taper tank and shows a modification of the positional relation between the two contact points and the fixed point.

The fixed point F is explained with reference to FIG. 5 and FIG. 6. FIG. 5 is a diagram showing a fixed point in a parallel tank. FIG. 5A shows the case in which the depth is large. FIG. 5B shows the case in which the depth is small. FIG. 5C shows a positional relation between two contact points and the fixed point. FIG. 6 is a diagram showing a fixed point in a taper tank. FIG. 6A shows the case in which the depth is large. FIG. 6B shows the case in which the depth is small. FIG. 6C shows a positional relation between two contact points and the fixed point. FIG. 6D shows a modification of the positional relation between the two contact points and the fixed point. Note that the figures shows horizontal sectional views of the main body section 5. The tank 3 and the support base section 22 are indicated by broken lines for convenience of explanation.

FIG. 5A to FIG. 5C show the case in which the tank 3 is a parallel tank including the parallel sidewall section 35. As explained above, the fixed point F is formed by the locking base section 24. Specifically, as shown in the figure, at least a pair of the locking base sections 24 is arranged along the center line direction Lm of the floating construction 1 and at least a pair of the locking base sections 24 is arranged along a width direction Lw perpendicular to the center line direction Lm, whereby the fixed point F is formed at the intersection of the center line direction Lm and the width direction Lw. The locking base sections 24 arranged along the center line direction Lm regulate movement of the tank in the width direction Lw while allowing movement in the center line direction Lm. The locking base sections 24 arranged along the width direction Lw regulate movement of the tank 3 in the center line direction Lm while allowing movement in the width direction Lw direction.

As shown in FIG. 5A, when the sidewall section 35 has fixed width along the center line direction Lm (the longitudinal direction) of the floating construction 1, in general, the fixed point F is arranged at the center point of the bottom surface of the tank 3. However, the fixed point F can be formed in an arbitrary position according to a type and a way of taking a posture of the floating construction 1, an arrangement position, of the tank 3, and the like. Note that three or more locking base sections 24 may be arranged in the directions of the center line direction Lm and the width direction Lw taking into account the rotation of the tank 3 and the horizontal load of the tank 3.

As shown in FIG. 5B, when the width of the depth direction (the center line direction Lm) of the tank 3 is small, at least one locking base section 24 may be arranged along the center line direction Lm of the floating construction 1 and at least one (in the figured, a pair of) locking base section 24 may be arranged along the width direction Lw perpendicular to the center line direction Lm, whereby the fixed point F may be formed at the intersection of the center line direction Lm and the width direction Lw. In this way, the fixed point F can be set in an arbitrary position by the locking base sections 24 that regulate movement of the tank 3 in the center line direction Lm or the width direction Lw. At this point, as shown in the figure, a part or all of the support base sections 22, which support the support blocks 4 arranged in the tank bottom surface section 31 opposed to the inclined surface or the multistage surface of the housing section 2, may be replaced with the locking base sections 24.

As shown in FIG. 5C, the support block bottom surface 41 and the support surface 22*a* (see FIG. 1A to FIG. 4B) in the first embodiment to the fifth embodiment include surfaces parallel to the plane S including the segment CC' connecting the two contact points (the first contact point C and the second contact point C') with the tank 3 in each of the support blocks 4 and the straight line Lf passing the fixed point F of the tank 3 and parallel to the segment CC'. That is, the plane S includes the perpendicular Lc drawn down from the first contact point C to the straight line Lf and the perpendicular Lc' drawn down from the first contact point C' to the straight line Lf. When the first contact point C and the second contact point C' are at the same height (horizontal position) and the segment CC' is parallel to the sidewall section 35, as explained above, the straight line Lf coincides with the center line direction Lm. The plane S coincides with a plane including the straight line connecting the first contact point C and the fixed point F and the straight line connecting the second contact point C' and the fixed point F.

The support block bottom surface 41 and the support surface 22*a* of the support base section 22 in another position include surfaces parallel to the plane S2 including the segment C2C2' connecting the two contact points (the first contact point C2 and the second contact point C2') with the tank 3 in each of the support blocks 4 and the straight line Lf2 passing the fixed point F of the tank 3 and parallel to the segment C2C2' (when the segment C2C2' is set parallel to the sidewall section 35, the straight line Lf2 coincides with the straight line Lf). That is, the plane S2 includes the perpendicular Lc2 drawn down from the first contact point C2 to the straight line Lf2 and the perpendicular Lc2' drawn down from the second contact point C2' to the straight line Lf2. When the first contact point C2 and the second contact point C2' are at the same height (horizontal position) and the segment C2C2' is parallel to the sidewall section 35, as shown in the figure, the straight line Lf2 coincides with the center line direction Lm. The plane S2 coincides with a plane including the straight line connecting the first contact point C2 and the fixed point F and the straight line connecting the second contact point C2' and the fixed point F.

Note that, in FIG. 5C, the four support blocks 4 and the four support base sections 22 are arranged in each of the left and the right for convenience of explanation. However, the arrangement (the number of matrixes) and the number of the support blocks 4 and the support base sections 22 are not limited to those shown in the figure.

FIGS. 6A to 6D show the case in which the tank 3 is a taper tank including the sidewall section 35 inclining in the center line direction Lm. As explained above, the fixed point F is formed by the locking base section 24. Specifically, as shown in the figure, at least the pair of locking base sections 24 is arranged along the center line direction Lm of the floating construction 1 and at least the pair of locking base sections 24 is arranged along the width direction Lw perpendicular to the center line direction Lm, whereby the fixed point F is formed at the intersection of the center line direction Lm and the width direction Lw. The locking base sections 24 arranged along the center line direction Lm regulate movement of the tank 3 in the width direction Lw while allowing movement in the center line direction Lm. The locking base sections 24 arranged along the width direction Lw regulate movement of the tank 3 in the center line direction Lm while allowing movement in the width direction Lw direction.

As shown in FIG. 6A, when the sidewall section 35 has a shape, the width of which changes along the center line direction Lm (the longitudinal direction) of the floating construction 1, the fixed point F is arranged, for example, further on a wide side (e.g., a rear side of the main body section 5) than the center point of the tank 3. However, the fixed point F can be formed in an arbitrary position according to a type and a way of taking a posture of the floating construction 1.

In general, the sidewall section 35 of the taper tank may be formed according to the shape of the main body section 5 and a taper surface or may be curved along the main body section 5. Further, even when the main body section 5 has a parallel shape as shown in FIG. 5A, depending on the structure in the main body section 5, the taper tank shown in FIG. 6A may be used. Note that three or more locking base sections 24 may be arranged in the directions of the center line direction Lm and the width direction Lw taking into account the rotation of the tank 3 and a horizontal load of the tank 3.

As shown in FIG. 6B, when the width in the depth direction (the center line direction Lm) of the tank 3 is small, at least one locking base section 24 may be arranged along the center line direction Lm of the floating construction 1 and at least one (in the figure, the pair of) locking base section 24 may be arranged along the width direction Lw perpendicular to the center line direction Lm, whereby the fixed point F may be formed at the intersection of the center line direction Lm and the width direction Lw. Consequently, the fixed point F can be set in an arbitrary position by the locking base sections 24 that regulate the movement of the tank 3 in the center line direction Lm or the width direction Lw. At this point, as shown in the figure, a part or all of the support base sections 22, which support the support blocks 4 arranged in the tank bottom surface section 31 opposed to the inclined surface or the multistage surface of the housing section 2, may be replaced with the locking base sections 24.

As shown in FIG. 6C, in the first embodiment to the fifth embodiment explained above, when the tank 3 is the taper tank, the support block 4 and the support base section 22 are arranged, for example, in the direction along the sidewall section 35 of the tank 3. The support block bottom surface 41 and the support surface 22*a* (see FIG. 1A to FIG. 4B) include the surfaces parallel to the plane S including the segment CC' connecting the two contact points (the first contact point C and the second contact point C') with the tank 3 in each of the support blocks 4 and the straight line Lf passing the fixed point F of the tank 3 and parallel to the segment CC'. That is, the plane S includes the perpendicular Lc drawn down from the first contact point C to the straight line Lf and the perpendicular Lc' drawn down from the second contact point C' to the straight line Lf. The plane S coincides with the plane including the straight line connecting the first contact point C and the fixed point F and the straight line connecting the second contact point C' and the fixed point F.

As shown in FIG. 6D, the support block 4 and the support base section 22 may be arranged in directions along the center line direction Lm and the width direction Lw. In this case, as in the arrangement shown in FIG. 6C, the support block bottom surface 41 and the support surface 22*a* include surfaces parallel to the plane S including the segment CC' connecting the two contact points (the first contact point C and the second contact point C') with the tank 3 in each of the support blocks 4 and the straight line Lf passing the fixed point F of the tank 3 and parallel to the segment CC'. That is, the plane S includes the perpendicular Lc drawn down from the first contact point C to the straight line Lf and the perpendicular Lc' drawn down from the second contact point C' to the straight line Lf. When the first contact point C and the second contact point C' are at the same height (horizontal position) and the segment CC' is parallel to the center line direction Lm, as shown in the figure, the straight line Lf coincides with the center line direction Lm. The plane S coincides with the plane including the straight line connecting the first contact point C and the fixed point F and the straight line connecting the second contact point C' and the fixed point F.

Note that, in FIG. 6C and the FIG. 6D, the one support block 4 and the one support base section 22 are arranged on the right side in the figure for convenience of explanation. However, the arrangement (the number of matrixes) and the number of the support blocks 4 and the support base sections 22 are not limited to those shown in the figure.

Figure 7A:
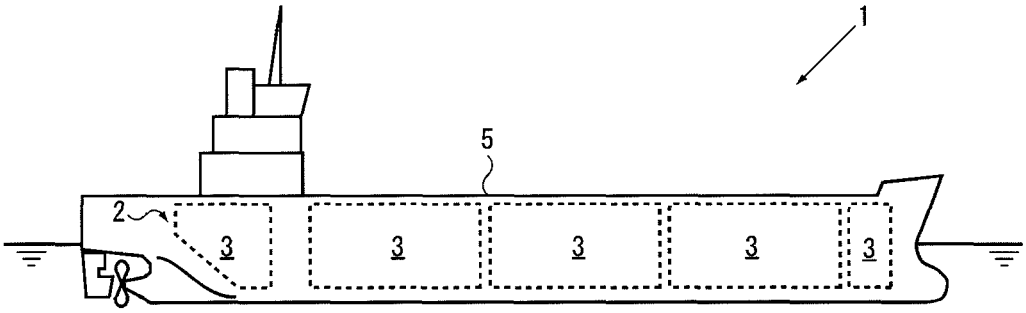
FIG. 7A is an overall configuration diagram of a floating construction in a tank support structure according to a sixth embodiment of the present invention.
Figure 7B:
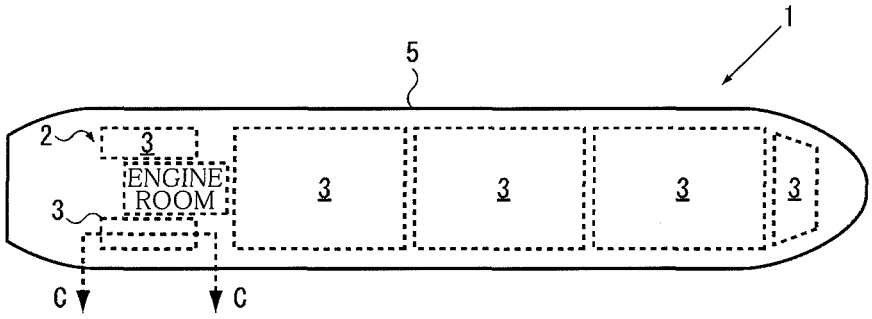
FIG. 7B is an overall configuration plan view of the floating construction in the tank support structure according to the sixth embodiment of the present invention.
Figure 7C:
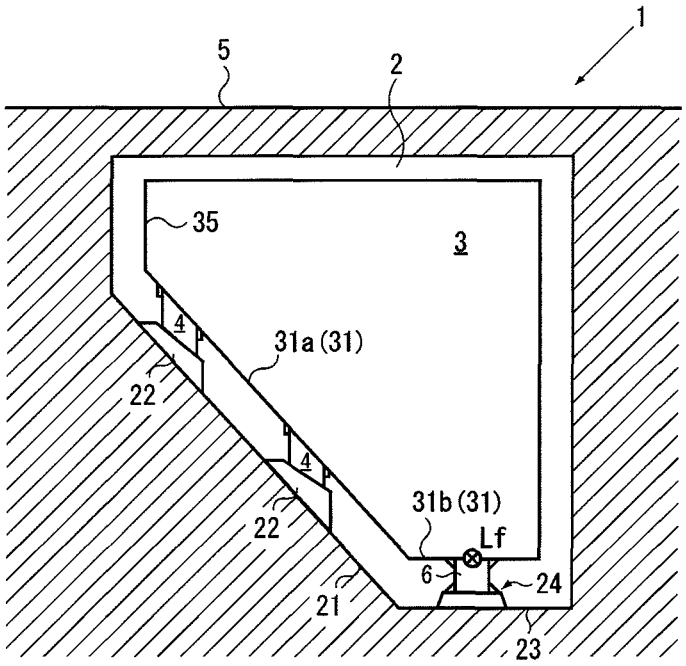
FIG. 7C is a C-C sectional view in FIG. 7B.

Lastly, a tank support structure according to a sixth embodiment of the present invention is explained with reference to FIG. 7. FIG. 7 is a diagram showing the tank support structure according to the sixth embodiment of the present invention. FIG. 7A is an overall configuration diagram of a floating construction. FIG. 7B is an overall configuration plan view of the floating construction. FIG. 7C is a C-C sectional view in FIG. 7B. Note that components same as those of the tank support structure in the first embodiment are denoted by the same reference numerals and signs and redundant explanation of the components is omitted.

As shown in FIG. 7B, sections (housing sections 2) long in the front back direction and short in the width direction are arranged on both sides of an engine room arranged in a rear section of the floating construction 1. As shown in FIG. 7A, the main body section 5 configuring the shell of such sections (housing sections 2) has a stream-line shape, a bottom section of which gradually inclines upward. The section (the housing section 2) includes a horizontal bottom surface and an inclining bottom surface to extend along the shape of the main body section 5. The tank 3 arranged in such a section (housing section 2) also includes a horizontal bottom surface and an inclining bottom surface.

In this way, when the tanks 3 are individually arranged in the housing sections 2 arranged on both sides of the main body section 5, as shown in FIG. 7C, the tank 3 having a shape obtained by dividing the tank 3 in the first embodiment into two is used. The bottom surface section 31 of the tank 3 includes the horizontal section 31*b* opposed to the bottom surface section 23 of the housing section 2 and the inclined section 31*a* opposed to the inclined surface 21 formed on the side surface of the housing section 2. Even when the tank 3 has the shape long in the front back direction of the main body section 5, the locking base section 24 is arranged such that the fixed point F is arranged in the bottom surface section 31 (the horizontal section 31*b*) of the tank 3. In particular, in the case of the tank 3 narrow in the width direction, for example, the locking base section 24 only has to be arranged in a state the same as a state in which the parallel tank having the narrow depth shown in FIG. 5B is rotated 90 degrees (a state in which the center line direction Lm and the width direction Lw are interchanged).

The sixth embodiment is explained with reference to the tank support structure according to the first embodiment. However, the configurations according to the second embodiment to the fifth embodiment may be applied as appropriate.

Note that, in the explanation of the first embodiment to the sixth embodiment explained above, the "vertical load" means a load that acts in the vertical direction when the floating construction 1 is supported on a stagnant water surface. The "horizontal load" means a load that acts in the horizontal direction when the floating construction 1 is supported on the stagnant water surface.

The present invention is not limited to the embodiments explained above. It goes without saying that various changes are possible without departing from the spirit of the present invention; for example, the present invention can be applied even when the housing section 2 includes the inclined surface 21 and the tank 3 includes a multistage surface.

REFERENCE SIGNS LIST

1 Floating construction
2 Housing section
3 Tank
4 Support block
5 Main body section
6 Locking block
21 Inclined surface
22 Support base section
22*a* Support surface
24 Locking base section
25 Multistage surface
31 Bottom surface section
32, 33 Frame body sections
34 Leg section
35 Sidewall section
41 Support block bottom surface

The invention claimed is:

1. A tank support structure comprising:

a tank mounted on a housing section formed in a floating construction, the tank support structure comprising:

an inclined surface or a multistage surface formed on a side surface section of the housing section; a plurality of support base sections arranged on the inclined surface or the multistage surface; and a plurality of support blocks arranged in a bottom surface section of the tank including a portion opposed to the inclined surface or the multistage surface and arranged on the support base sections, wherein support block bottom surfaces arranged on the support base sections of the support blocks and support surfaces of the support base sections that support the support blocks have surfaces parallel to a plane including a segment connecting two contact points with the tank in each of the support blocks and a straight line passing a fixed point of the tank and parallel to the segment.

2. The tank support structure according to claim 1, comprising: a locking base section arranged in a bottom surface center section of the housing section; and a locking block arranged in a bottom surface center section of the tank and arranged on the locking base section, wherein the fixed point is formed by locking the locking block to the locking base section.

3. The tank support structure according to claim 2, wherein at least one of the locking base section is arranged along a center line direction of the floating construction and at least one of the locking base section is arranged along a width direction perpendicular to the center line direction, whereby the fixed point is formed at an intersection of the center line direction and the width direction.

4. The tank support structure according to claim 1, wherein at least one of the two contact points is a contact point of the support block with the tank most distant from the fixed point.

5. The tank support structure according to claim 1, wherein the support surfaces are formed wider than the support block bottom surfaces in an inclining direction.

6. The tank support structure according to claim 1, wherein, in the bottom surface section of the tank, an area of the portion opposed to the inclined surface or the multistage surface is formed larger than a portion opposed to the bottom surface section of the housing section.

7. The tank support structure according to claim 1, wherein the tank includes a frame body section that locks the support blocks.

8. The tank support structure according to claim 1, wherein the tank includes leg sections projecting downward, the support blocks are arranged on the leg sections, and the support block bottom surfaces and the support surfaces are formed with the leg sections set as a part of the tank.

9. The tank support structure according to claim 1, wherein the tank includes a sidewall section having fixed width along a center line direction of the floating construction or a sidewall section, a width of which changes along the center line direction of the floating construction.

10. A floating construction comprising: a main body section supported on water by buoyancy; and a housing section formed in the main body section and having a tank mounted therein, wherein the tank is mounted on the housing section by the tank support structure according to claim 1.

11. A floating construction comprising: a main body section supported on water by buoyancy; and a housing section formed in the main body section and having a tank mounted therein, wherein the tank is mounted on the housing section by the tank support structure according to claim 2.

12. A floating construction comprising: a main body section supported on water by buoyancy; and a housing section formed in the main body section and having a tank mounted therein, wherein the tank is mounted on the housing section by the tank support structure according to claim 3.

13. A floating construction comprising: a main body section supported on water by buoyancy; and a housing section formed in the main body section and having a tank mounted therein, wherein the tank is mounted on the housing section by the tank support structure according to claim 4.

14. A floating construction comprising: a main body section supported on water by buoyancy; and a housing section formed in the main body section and having a tank mounted therein, wherein the tank is mounted on the housing section by the tank support structure according to claim 5.

15. A floating construction comprising: a main body section supported on water by buoyancy; and a housing section formed in the main body section and having a tank mounted therein, wherein the tank is mounted on the housing section by the tank support structure according to claim 6.

16. A floating construction comprising: a main body section supported on water by buoyancy; and a housing section formed in the main body section and having a tank mounted therein, wherein the tank is mounted on the housing section by the tank support structure according to claim 7.

17. A floating construction comprising: a main body section supported on water by buoyancy; and a housing section formed in the main body section and having a tank mounted therein, wherein the tank is mounted on the housing section by the tank support structure according to claim 8.

18. A floating construction comprising: a main body section supported on water by buoyancy; and a housing section formed in the main body section and having a tank mounted therein, wherein the tank is mounted on the housing section by the tank support structure according to claim 9.

* * * * *